US012201173B1

(12) United States Patent
Morejon

(10) Patent No.: US 12,201,173 B1
(45) **Date of Patent: *Jan. 21, 2025**

(54) SPORT GLOVES WITH PADDING

(71) Applicant: Lazaro J. Morejon, Las Vegas, NV (US)

(72) Inventor: Lazaro J. Morejon, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/213,760

(22) Filed: Jun. 23, 2023

Related U.S. Application Data

(63) Continuation of application No. 17/395,429, filed on Aug. 5, 2021, now Pat. No. 11,730,212.

(60) Provisional application No. 63/061,625, filed on Aug. 5, 2020.

(51) Int. Cl.
*A41D 19/015* (2006.01)

(52) U.S. Cl.
CPC ..... *A41D 19/01523* (2013.01)

(58) Field of Classification Search
CPC ..... A41D 19/01523; A41D 19/015
See application file for complete search history.

(56) References Cited

U.S. PATENT DOCUMENTS 4,329,741 A 5/1982 Bach
4,748,690 A 6/1988 Webster
5,697,104 A 12/1997 Welton
5,855,022 A 1/1999 Storto
6,098,200 A 8/2000 Minkow et al.
6,216,276 B1 4/2001 Eibert
6,775,847 B2 8/2004 Terris et al.
7,966,670 B2 6/2011 Wilbert et al.
8,297,601 B2 10/2012 Vito et al.
9,630,083 B2 4/2017 McCrane
9,669,283 B2 6/2017 Ramirez
9,962,594 B2 5/2018 Ramirez
10,117,558 B1 11/2018 Restrepo
10,405,601 B2 9/2019 Kuefler et al.
10,549,404 B1 * 2/2020 Norton ..... A41D 19/01594
11,730,212 B1 * 8/2023 Morejon ..... A41D 19/01523 2/161.1
2003/0061651 A1 4/2003 DeRose, Sr.
2005/0229285 A1 10/2005 Chung
2006/0026738 A1 2/2006 Kleinert
2009/0210991 A1 * 8/2009 Tutor ..... A41D 19/015 2/167
2011/0126336 A1 6/2011 Johnson
2013/0007937 A1 1/2013 Stone et al.
2016/0120242 A1 5/2016 Thompson et al.
2016/0375344 A1 12/2016 Restko et al.
(Continued)

*Primary Examiner* — Bao-Thieu L Nguyen
(74) *Attorney, Agent, or Firm* — Howard & Howard Attorneys PLLC

(57) ABSTRACT

A pair of sport gloves for properly positioning a bat and for protecting a dominant hand and a secondary hand of a player. The pair of sport gloves includes a first sport glove adapted to fit over the dominant hand and a second sport glove adapted to fit over the secondary hand. The first sport glove includes a first padding assembly that includes a first palm pad and a webspace pad including a generally triangular shape. The second sport glove includes a second padding assembly that is different from the first padding assembly. The second padding assembly includes a second palm pad and a heal pad including a rectangular shape.

8 Claims, 13 Drawing Sheets

(56) References Cited

U.S. PATENT DOCUMENTS

| | | | |
|---|---|---|---|
| 2018/0154243 | A1 | 6/2018 | Kieman |
| 2018/0193718 | A1 | 7/2018 | Gilday et al. |
| 2019/0069626 | A1 | 3/2019 | Kuefler et al. |
| 2019/0098945 | A1 | 4/2019 | Lim |
| 2019/0176014 | A1 | 6/2019 | Chen et al. |
| 2019/0364997 | A1 | 12/2019 | Chen et al. |
| 2020/0077723 | A1 | 3/2020 | Hyland |
| 2021/0146227 | A1 | 5/2021 | Bhagwat |
| 2021/0195972 | A1 | 7/2021 | Leone et al. |
| 2021/0219637 | A1 | 7/2021 | Iacono |
| 2022/0212087 | A1 | 7/2022 | Kucharsky et al. |

* cited by examiner

SPORT GLOVES WITH PADDING

CROSS-REFERENCE TO RELATED APPLICATION

This application is a continuation of U.S. patent application Ser. No. 17/395,429, filed Aug. 5, 2021, which claims the benefit of Provisional Patent Application No. 63/061,625, filed on Aug. 5, 2020, the disclosures of which are hereby incorporated by reference in their entirety for all purposes.

FIELD OF THE DISCLOSURE

The present disclosure relates generally to the field of gloves for use in sports and more specifically, relates to baseball and softball gloves used to assist a baseball or softball player in holding and manipulating a baseball or softball bat.

BACKGROUND OF THE INVENTION

A large number of sports participants use sports gloves or other protective hand coverings. The protective hand coverings are used by athletes when playing sports that require the use of hand-held implements such as baseball/softball bats, golf clubs, tennis racquets, hockey sticks, lacrosse sticks and the like. Repetitive use of such implements can subject the athlete's hands to stress from impacts with a ball or puck. For example, a baseball player that repetitively hits baseballs with a baseball bat can often experience soreness or pain in the hand. While protective hand coverings such as batting gloves according to the prior art, provide a number of advantages, they have limitations. For example, existing batting glove designs incorporate padding just for protection of the hand and the designs lack minimizing the impact to the hand and do not help position the hands properly.

The present disclosure is aimed at solving one or more of the problems identified above.

SUMMARY OF THE INVENTION

In one aspect of the present invention, a pair of sport gloves for properly positioning a bat and for protecting a dominant hand and a secondary hand of a player is provided. The pair of sport gloves includes a first sport glove adapted to fit over the dominant hand and a second sport glove adapted to fit over the secondary hand. The first sport glove includes a first padding assembly including a first palm pad extending across a palm portion of the first sport glove and adjacent to finger portions of the first sport glove, and a webspace pad including a generally triangular shape and spaced from the first palm pad to form a first recess between the webspace pad and the first palm pad configured to receive a handle of the bat. The second sport glove includes a second padding assembly that is different from the first padding assembly. The second padding assembly includes a second palm pad extending across a palm portion of the second sport glove adjacent to finger portions of the second sport glove, and a heal pad including a rectangular shape and spaced from the second palm pad to form a second recess between the heal pad and the second palm pad configured to receive the handle of the bat.

In another aspect of the present invention, a padding system adapted to be worn over a pair of sport gloves for properly positioning a bat and for protecting a dominant hand and a secondary hand of a player is provided. The padding system includes a dominant padding assembly adapted to be coupled to a first sport glove worn over the dominant hand and a secondary padding assembly adapted to be coupled to a second sport glove worn over the secondary hand. The dominant padding assembly includes a first palm pad extending across a palm portion of the first sport glove and adjacent to finger portions of the first sport glove, and a webspace pad including a generally triangular shape and spaced from the first palm pad to form a first recess between the webspace pad and the first palm pad configured to receive a handle of the bat. The secondary padding assembly is different than the dominant padding assembly and includes a second palm pad extending across a palm portion of the second sport glove adjacent to finger portions of the second sport glove, and a heal pad including a rectangular shape and spaced from the second palm pad to form a second recess between the heal pad and the second palm pad configured to receive the handle of the bat;

In yet another aspect of the present invention, a sport glove assembly for properly positioning a bat and for protecting a dominant hand of a player is provided. The sport glove assembly including a sport glove, the sport glove including a body, a webspace pad, and at least one recess. The body including a thumb portion, a plurality of finger portions, a front surface, and a back surface. The front and back surface coupled along at least one edge defining a cavity. The front surface including a palm portion having a distal end and a proximal end, the thumb portion and the plurality of finger portions extending from the distal end of the palm portion, the thumb portion and the plurality of finger portions each having a distal end and a proximal end. The webspace pad coupled to the body, the webspace pad including a plurality of sides, one side of the webspace pad positioned at the proximal end of the thumb portion, wherein the webspace pad extends inward towards the palm portion from the proximal end of the thumb portion and at least one recess formed between the webspace pad and the front surface of the body.

In a further aspect of the present invention, a pair of sport gloves for properly positioning a bat and for protecting a dominant hand and a secondary hand of a player is provided. The pair of sport gloves including a body, a webspace pad, at least one recess, a secondary body, a heel pad, and a secondary recess. The body including a thumb portion, a plurality of finger portions, a front surface, and a back surface. The front and back surface coupled along at least one edge defining a cavity, the front surface including a palm portion having a distal end and a proximal end, the thumb portion and the plurality of finger portions extending from the distal end of the palm portion, the thumb portion and the plurality of finger portions each having a distal end and a proximal end. The webspace pad coupled to the body, the webspace pad including a plurality of sides, one side of the webspace pad positioned at the proximal end of the thumb portion, wherein the webspace pad extends inward towards the palm portion from the proximal end of the thumb portion. The at least one recess formed between the webspace pad and the front surface of the body. The secondary body including a thumb portion, a plurality of finger portions, a front surface, and a back surface, the front and back surface coupled along at least one edge defining a cavity, the front surface including a palm portion having a distal end and a proximal end, the thumb portion and the plurality of finger portions each having a distal end and a proximal end. The heel pad coupled to the body and including a plurality of sides, one side of the heel pad positioned at the proximal end of the palm portion, wherein the heel pad extends inwards towards the palm portion opposite the cavity. The secondary recess formed between the heel pad and the front surface of the body.

BRIEF DESCRIPTION OF THE DRAWINGS

Non-limiting and non-exhaustive embodiments of the present invention are described with reference to the following figures. Other advantages of the present disclosure will be readily appreciated, as the same becomes better understood by reference to the following detailed description when considered in connection with the accompanying drawings wherein.

Corresponding reference characters indicate corresponding components throughout the several views of the drawings.

DETAILED DESCRIPTION OF THE INVENTION

The present disclosure, as shown in FIGS. 1-17, provides a pair of sport gloves for properly positioning a hand-held implement. More specifically, the present disclosure provides a sport glove 10 for properly positioning a hand-held implement and for protecting a dominant hand of a user or player. In the illustrated embodiment, the sport glove assembly 11 includes a sport glove 10 is a batting glove for use by a batter and the hand-held implement is a baseball or softball bat. However, the sport glove 10 may be configured or used with other types of hand-held implements, including but not limited to golf clubs, tennis racquets, hockey sticks, lacrosse sticks or the like.

In one embodiment, the sport glove assembly 11 may be used for different sports, such as, but not limited to, baseball, softball, golf, lacrosse, tennis, hockey, etc. The sport glove assembly 11 may be designed for any sport that may use a bat, club, or stick where the player must grab a handle or shaft to play.

In one embodiment, the dominant sport glove 10 is for a right-handed player. In another embodiment, the dominant sport glove 10 is for a left-handed player. It is understood that the embodiment discussed and shown herein is for a right-handed batter, but the sport glove 10 has the appearance of a mirror image of the glove shown for a left-handed batter or player.

Figure 1A:
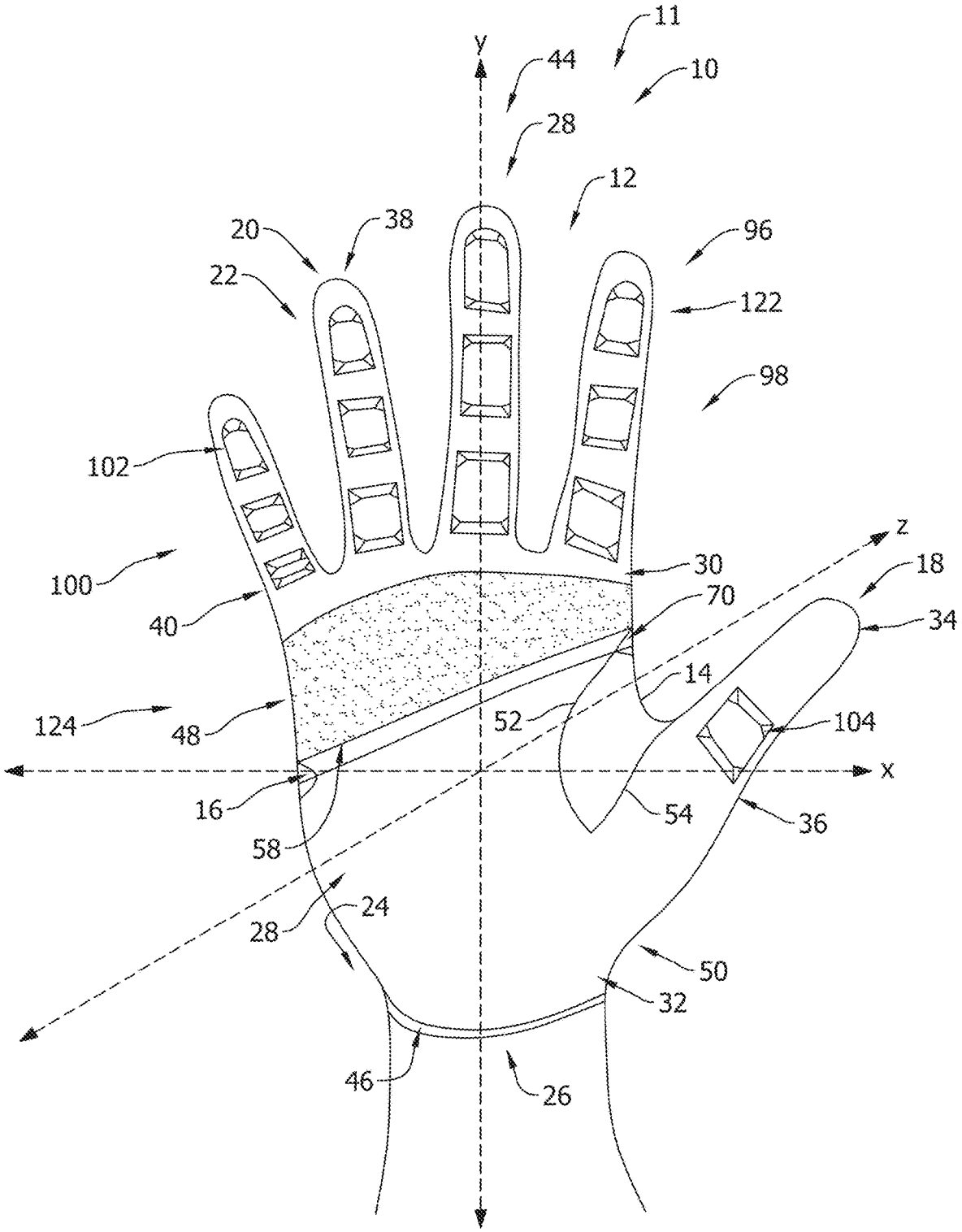
FIG. 1A illustrates a dominant sport glove, according to an embodiment of the present invention.

As shown in FIG. 1A, the sport glove 10 for properly positioning a bat and for protecting the dominant hand of a player includes a body 12, a webspace pad 14, and at least one recess 16. The body 12 includes a thumb portion 18, a plurality of finger portions 20, a front surface 22, and a back surface 24. The front 22 and back surface 24 are coupled along at least one edge to define a cavity 26. The front surface 22 is opposite the back surface 24 along a z-axis. The front surface 22 includes a palm portion 28 having a distal end 30 and a proximal end 32. The thumb portion 18 and the plurality of finger portions 20 are extending from the distal end 30 of the palm portion 28. The thumb portion 18 and the plurality of finger portions 20 each have a distal end 34, 38 and a proximal end 36, 40. The webspace pad 14 is coupled to the body 12. The webspace pad 14 includes a plurality of sides. One side of the webspace pad is positioned at the proximal end 36 of the thumb portion 18. The webspace pad 14 extending inward towards the palm portion 28 away from the proximal end 36 of the thumb portion 18. The at least one recess 16 formed between the webspace pad 14 and the front surface 22 of the body 12.

Figure 1B:
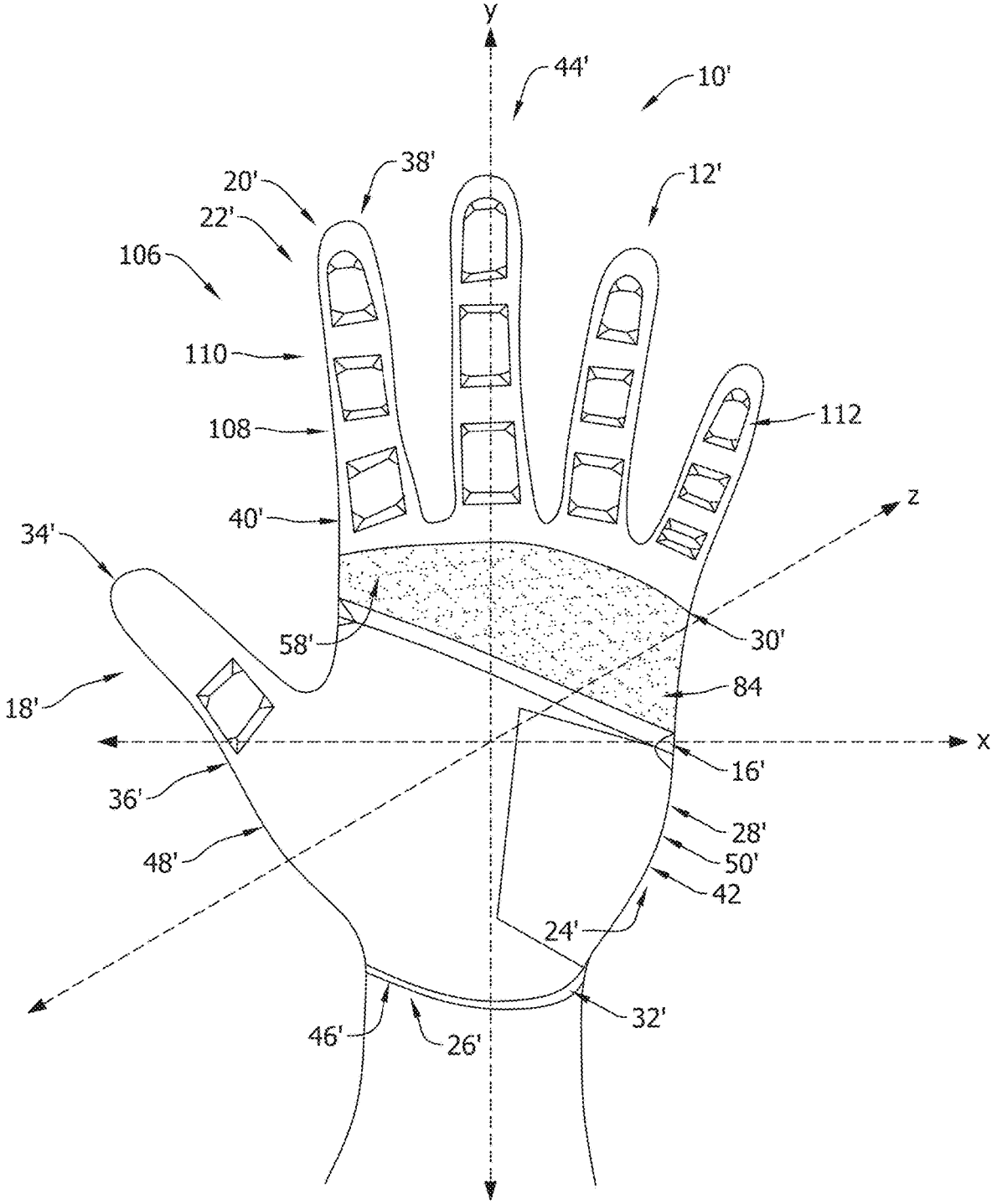
FIG. 1B illustrates a second sport glove, according to an embodiment of the present invention.

As shown in FIG. 1B, the sport glove assembly 11 includes a second sport glove 10', the second sport glove 10' includes secondary body 12', a heel pad 42, and at least one recess 16'. The secondary body 12' includes a thumb portion 18', a plurality of finger portions 20', a front surface 22', and a back surface 24'. The front surface 22' and the back surface 24' are coupled along at least one edge defining a cavity 26'. The front surface 22' including a palm portion 28' having a distal end 30' and a proximal end 32'. The thumb portion 18' having a distal end 34' and a proximal end 36'. The plurality of finger portions 20' each having a distal end 38' and a proximal end 40'. The heel pad 42 is coupled to the secondary body 12' and includes a plurality of sides 44.

The front surface 22, 22' and the back surface 24, 24' of the body 12, 12' are coupled along at least one edge defining the cavity or opening 26, 26'. The bottom 46, 46' includes the opening 26, 26'. The opening 26, 26' is configured to receive the hand of the batter where the hand extends into the plurality of finger portions 20, 20' of the body 12, 12' or batting glove.

The front surface 22, 22' includes the palm portion 28, 28' having the distal end 30, 30' and the proximal end 32, 32'. The thumb portion 18, 18' and the plurality of finger portions 20, 20' extend from the distal end 30, 30' of the palm portion 28, 28'. The thumb portion 18, 18' has a distal end 34, 34' and a proximal end 36, 36'. The plurality of finger portions 20, 20' each have a distal end 38, 38' and a proximal end 40, 40'.

As shown in FIGS. 1A-1B, the body (second body) 12, 12', or batting glove, has a top 44, 44' and a bottom 46, 46', where the bottom 46, 46' is opposite the top 44, 44' along a y-axis, a left side 48, 48' and a right side 50, 50', where the right side 50, 50' is opposite the left side 48, 48' along an x-axis.

The body 12, 12' can have multiple sizes to fit most hands and can be made out of any known material such as, leather, synthetic leather, mesh, Spandex, neoprene, Lycra™ fabric, synthetic material or other suitable material.

Figure 2:
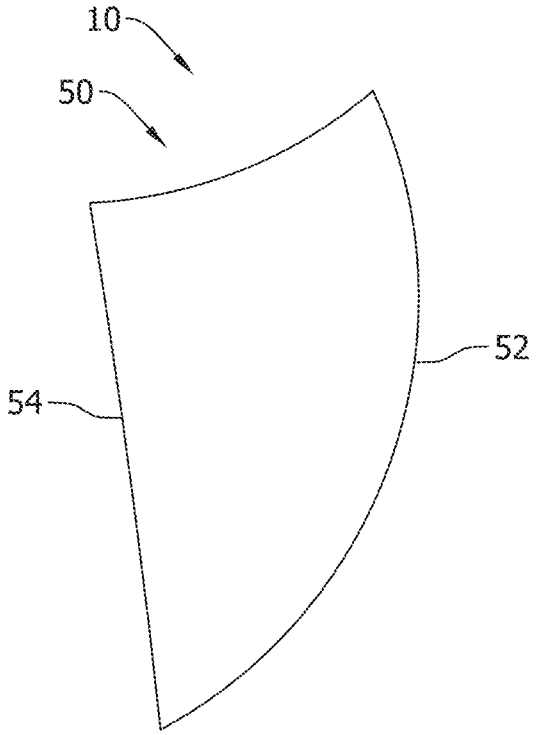
FIG. 2 illustrates a perspective view of a webspace pad coupled to the sport glove of FIG. 1A.

As shown in FIGS. 1A and 2, the webspace pad 14 is coupled to the body 12 where the webspace pad 14 includes a plurality of sides. At least one side of the webspace pad 14 is positioned at the proximal end 36 of the thumb portion 18. The webspace pad 14 is positioned to extend inward towards the palm portion 28 from the proximal end 36 of the thumb portion 18. The webspace pad 14 includes a curved side 52 facing the left side 46 of the body 12 and a bottom side 54 parallel to the bottom 46 of the body 12.

Figure 3:
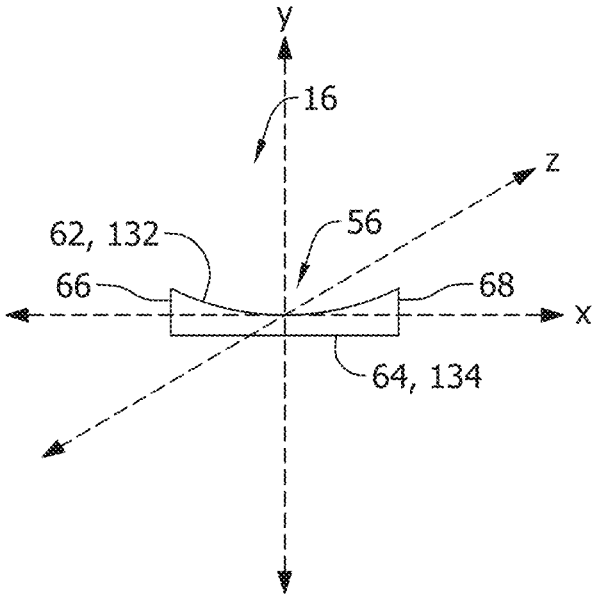
FIG. 3 illustrates a perspective view of a palm pad coupled to the sport glove of FIG. 1A.

A recess 16 is formed between the webspace pad 14 and the front surface 22 of the body 12. As shown in FIG. 3, the recess 16 creates an angle 56 between the webspace pad 14 and the front surface 22. The angle 56 is between 5° and 1800 degrees. The recess 16 is configured to receive the bat when the player is using the sport glove 10.

Figure 4:
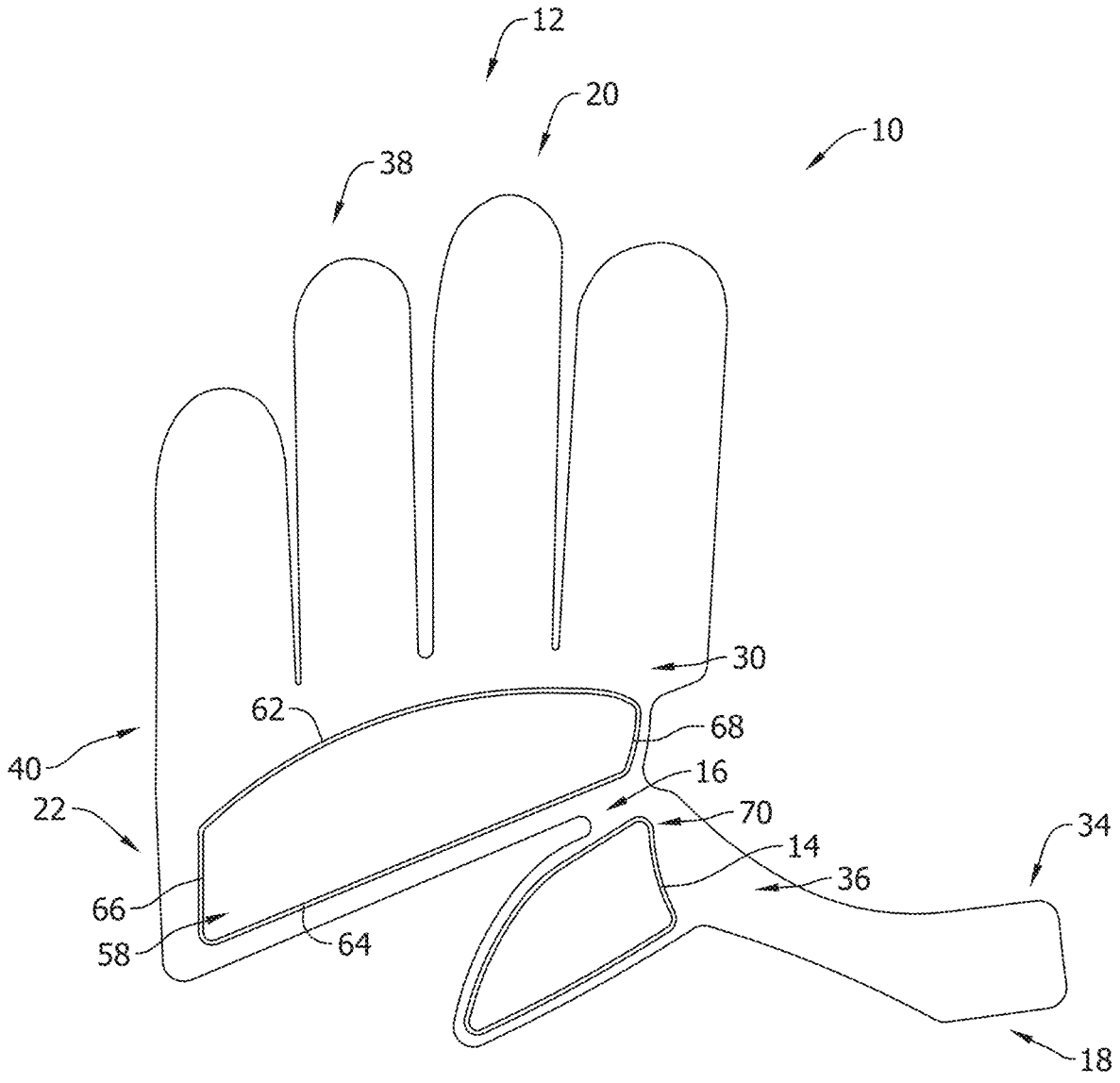
FIG. 4 illustrates a perspective view of the webspace pad and the palm pad coupled to the sport glove of FIG. 1A.

In one embodiment, the sport glove 10 includes a palm pad 58. The palm pad 58 is coupled to the front surface 22 of the body 12. As shown in FIG. 4, the palm pad 58 includes a plurality of sides 60 including a top side 62, a bottom side 64, a left side 66, and a right side 68. The at least one side 62, top side, is positioned along the proximal end 40 of the plurality of fingers portions 20. The at least one side 62 is positioned where the proximal end 40 of the plurality of fingers portions 20 meet the distal end 30 of the palm portion. The top side 62 is curved to be parallel or mirror the curve of the hand. The left side 66 is parallel to the left side 46 of the body and the right side 68 is parallel to the right side 48 of the body 12. The bottom 64 of the palm pad 58 is parallel to the bottom 44 of the body 12.

Figure 5:
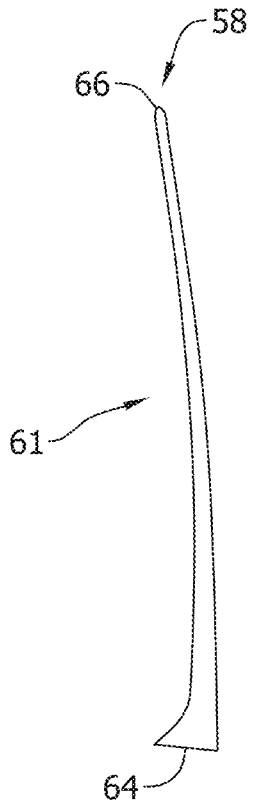
FIGS. 5-6 illustrate perspective views of the webspace pad and the palm pad coupled to the sport glove of FIG. 1A.

In yet another embodiment, as shown in FIG. 5, the palm pad 58 is as described above except that the bottom 64 of the palm pad 58 is parallel with the curve or recessed channel and both the top 62 and the bottom 64 are higher than the center. This embodiment creates a curve to better receive the bat or instrument being used by the player.

In yet another embodiment, the webspace pad 14 and the palm pad 58 are coupled to one another. For example, the webspace pad 14 and the palm pad 58 are one pad coupled to the body 12. In another embodiment, the webspace pad 14 and the palm pad 58 are separate pads coupled to the body 12.

In another embodiment, the webspace pad 14 and the palm pad 58 are made out of a material, for example, but not limited to silicon, foam, foam plastic, neoprene, rubber, silicon rubber, polyurethane, a gel, conventional foam rubbers, cotton batting, and other elastomers used in sports gloves. The material used is configured to cushion and provide shock absorption to protect the hands of the batter.

Figure 6:
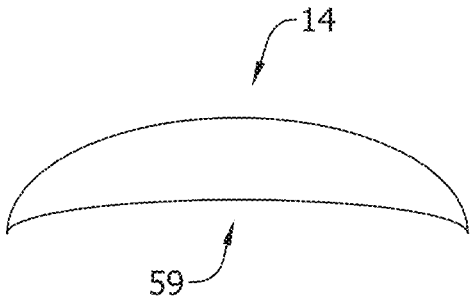

The webspace pad 14 has a thickness between 0.010 millimeters and 5.00 millimeters. The palm pad 58 has a thickness between 0.010 millimeters and 5.00 millimeters. The thickness may vary depending on the shape of the crescent of the corresponding pad. As shown in FIG. 6, the thickness of the webspace pad 14 is curved where the curve creates an angle 59. The angle 59 is between 5° and 180° degrees. As shown in FIG. 5, the thickness of the palm pad 58 is curved where the curve creates an angle 61. The angle 61 is between 5° and 180° degrees.

In another embodiment, the webspace pad 14 has a thickness between 0.010 inches and 0.500 inches and the palm pad 58 has a thickness between 0.010 inches and 0.500 inches.

Figure 7:
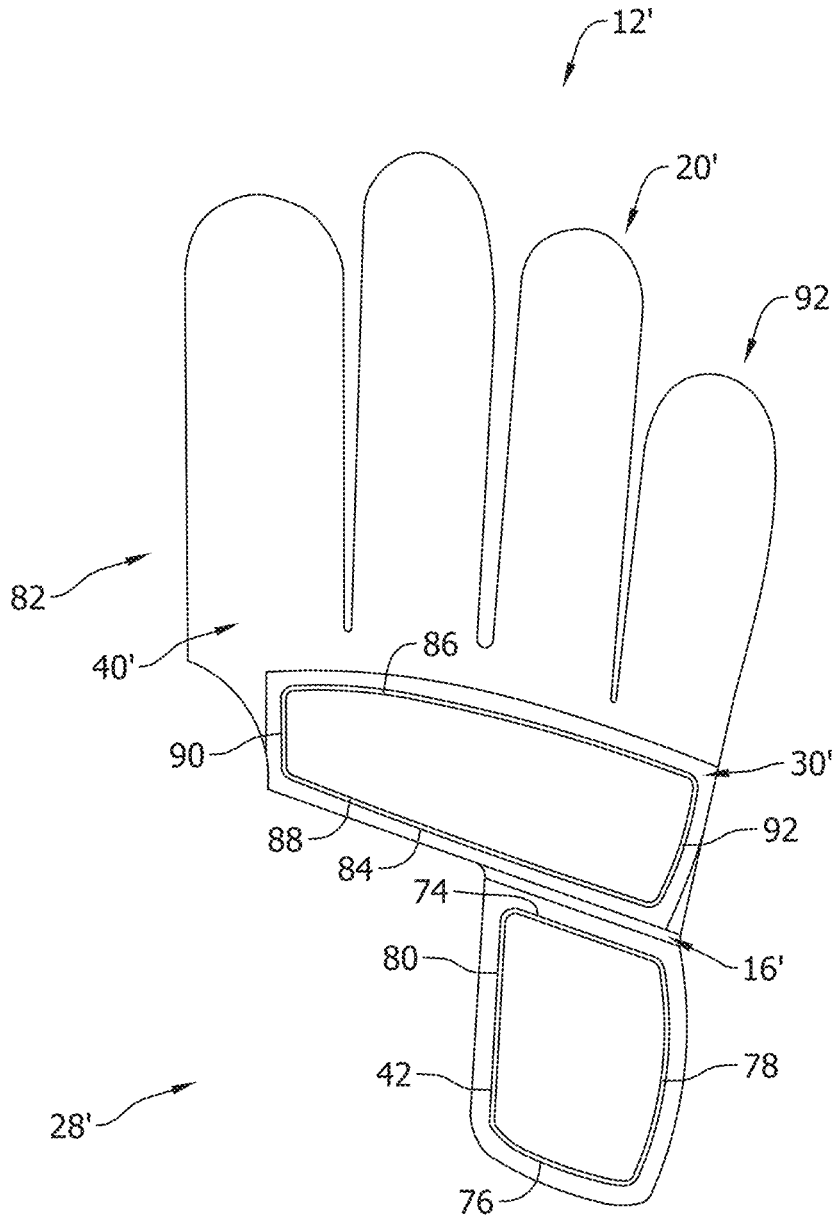
FIG. 7 illustrates a perspective view of a heel pad and a palm pad coupled to the sport glove of FIG. 1B.

A second recess 70 is formed between the webspace pad 14 and the palm pad 58. The second recess 70 having a different angle between the webspace pad 14 and the palm pad 58 than the angle created by the first recess 16 between the webspace pad 14 and the front surface 22. The second recess 70 is configured to help receive the bat when the player is using the sport glove 12. The angle is between 5° and 180° degrees As shown in FIG. 7, the heel pad 42 has a top 74, a bottom 76, a right side 78, and a left side 80. One side, the top side 74, is positioned at the proximal end 32' of the palm portion 28'. The bottom 76 of the heel pad 42 extends inwards towards the palm portion 28' opposite the cavity. Each side of the plurality of sides 82 have specific curves to assist with the positioning of the bat and protection of the hand. The secondary recess 16' is formed between the heel pad 42 and the front surface 22' of the body 12'. The secondary recess 16' is configured to receive the bat when the player is using the sport glove 10'. When the player uses the secondary body 12', the secondary recess 16' allows the glove to be flush with the base or butt of a bat.

In one embodiment, the sport glove 10' includes a secondary palm pad 84 coupled to the front surface 22' of the secondary body 12' shown in FIG. 7. The secondary palm pad 84 includes a plurality of sides including a top side 86, a bottom side 88, a left side 90, and a right side 92. The at least one side, the top side 86, is positioned where the proximal end 40' of the plurality of fingers 20' meet the distal end 30' of the palm portion 28'. The top side 86 is curved to be parallel or mirror the curve of the hand. The left side 90 is parallel to the left side 48' of the body and the right side 68 is parallel to the right side 50' of the body 12'. The bottom 88 of the palm pad 84 is parallel to the bottom 46' of the body 12.

In various embodiments, the heel pad 42 and the secondary palm pad 84 are coupled to one another. The heel pad 42 and the secondary palm pad 84 are separate pads coupled to the secondary body 12'. The heel pad 42 and the secondary palm pad 84 are one pad coupled to the secondary body 12'.

In another embodiment, the heel pad 42 and the secondary palm pad 84 are made out of a material, for example, but not limited to silicon, foam, foam plastic, neoprene, rubber, silicon rubber, polyurethane, a gel, conventional foam rubbers, cotton batting, and other elastomers used in sports gloves. The material used is configured to cushion and provide shock absorption to protect the hands of the batter.

The heel pad 42 has a thickness between 0.010 millimeters and 5.00 millimeters. The secondary palm pad 84 has a thickness between 0.010 millimeters and 5.00 millimeters. The thickness may vary depending on the shape of the curve of the corresponding pad.

In another embodiment, the heel pad 42 has a thickness between 0.010 inches and 0.500 inches and the secondary palm pad 84 has a thickness between 0.010 inches and 0.500 inches.

Figure 8:
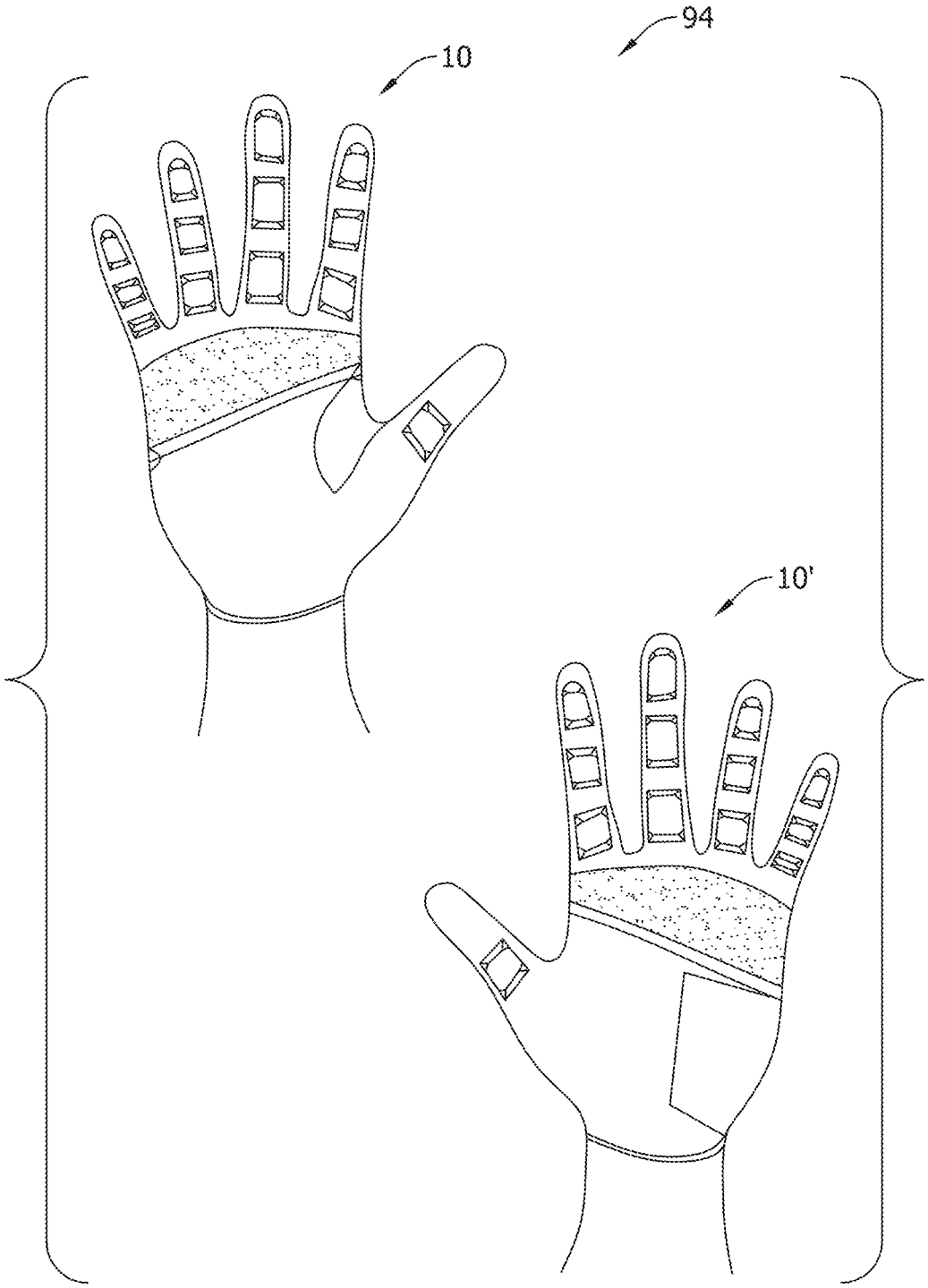
FIG. 8 illustrates a pair of sport gloves, according to another embodiment of the present invention.

As shown in FIG. 8, a pair of sport gloves 94 for properly positioning a bat and for protecting a dominant hand and a secondary hand of a player. The pair of sport gloves 94 includes the body 12, the webspace pad 14, at least one recess 16, a secondary body 12', the heel pad 42, and the secondary recess 16'. Both bodies 12, 12' include the thumb portion 18, 18', the plurality of finger portions 20, 20', the front surface 22, 22', and a back surface 24, 24'. The front surface 22, 22' and the back surface 24, 24' are coupled along at least one edge defining a cavity 26, 26'. The front surface 22, 22' including the palm portion 28, 28' having the distal end 30, 30' and the proximal end 32, 32'. The thumb portion 18, 18' and the plurality of finger portions 20, 20' extending from the distal end 30, 30' of the palm portion 28, 28'. The thumb portion 18, 18' having the distal end 34, 34' and the proximal end 36, 36' and the plurality of finger portions 20, 20' each having the distal end 38, 38' and a proximal end 40, 40'.

The webspace pad 14 is coupled to the body 12. The webspace pad 14 includes the plurality of sides where one side 52 of the webspace pad 14 is positioned at the proximal end 36 of the thumb portion 18. The webspace pad 14 extends inward towards the palm portion 28 from the proximal end 36 of the thumb portion 18. The at least one recess 16 is formed between the webspace pad 14 and the front surface 22 of the body 12. The heel pad 42 is coupled to the secondary body 12' and includes a plurality of sides 82. One side 76 of the heel pad 42 is positioned at the proximal end 32' of the palm portion 28'. The heel pad 42 extends inwards towards the palm portion 28' opposite the cavity 26'. The secondary recess 16' is formed between the heel pad 42 and the front surface of the body 22'.

As shown in FIG. 1A, the present invention further includes a dominant padding assembly 96 including a plurality of pads 98 and a plurality of recesses 100. The padding assembly 96 is coupled to the body 12. The plurality of pads 98 includes a plurality of finger pads 102, at least one palm pad 58 and a plurality of thumb pads 104. The plurality of recesses 100 are configured to assist the batter to comfortably receive the bat and position the sport glove 10 around the bat or shaft of the bat.

In one embodiment, the front surface 22 of the body 12 is configured to receive the dominant padding assembly 96. The plurality of pads further includes the webspace pad 14 and the palm pad 58. The dominant padding assembly 96 is coupled to the front surface 22 of the body 12.

In yet another embodiment, the front surface 22' of the secondary body 12' is configured to receive a secondary padding assembly 106. The secondary padding assembly 106 includes a plurality of recesses 108, a plurality of pads 110 including at least a plurality of finger pads 112, a plurality of thumb pads 114, the heel pad 42, and the secondary palm pad 84. The secondary padding assembly 106 is coupled to the front surface 22' of the secondary body 12'. The secondary padding assembly 106 includes the same configuration as the dominant padding assembly 96 as described herein.

In a first embodiment, the dominant padding assembly 96 may be coupled to the body 12 via a pocket formed by sewing a lining inside the body 12 where the plurality of pads are inserted into the pocket.

In a second embodiment, the padding assembly 96 may be coupled to the body 12 via a pocket formed by sewing a lining on the outside of the body 12. The pads of the dominant padding assembly 96 are inserted into the pocket on the outside of the body 12.

In a third embodiment, the dominant padding assembly 96 and the body 12 may be manufactured together as one piece of material, leaving a space or pocket for the plurality of pads 98. The plurality of pads 98 are one pad made of silicone with the body 12 of the sport glove 10 around the plurality of pads 98. The plurality of pads 98 are built into the body 12 of the sport glove 10.

Figure 9:
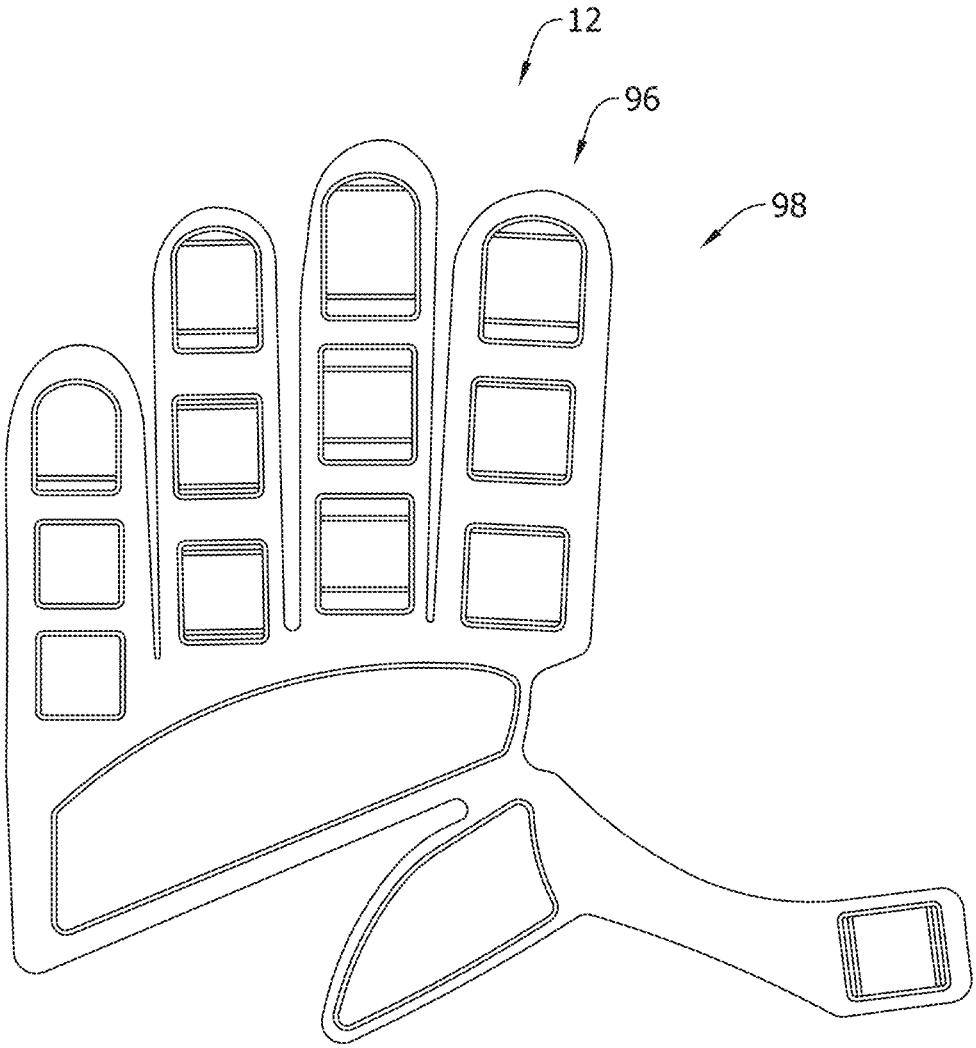
FIGS. 9-10 illustrate a perspective view a plurality of pads, according to an embodiment of the present invention.
Figure 10:
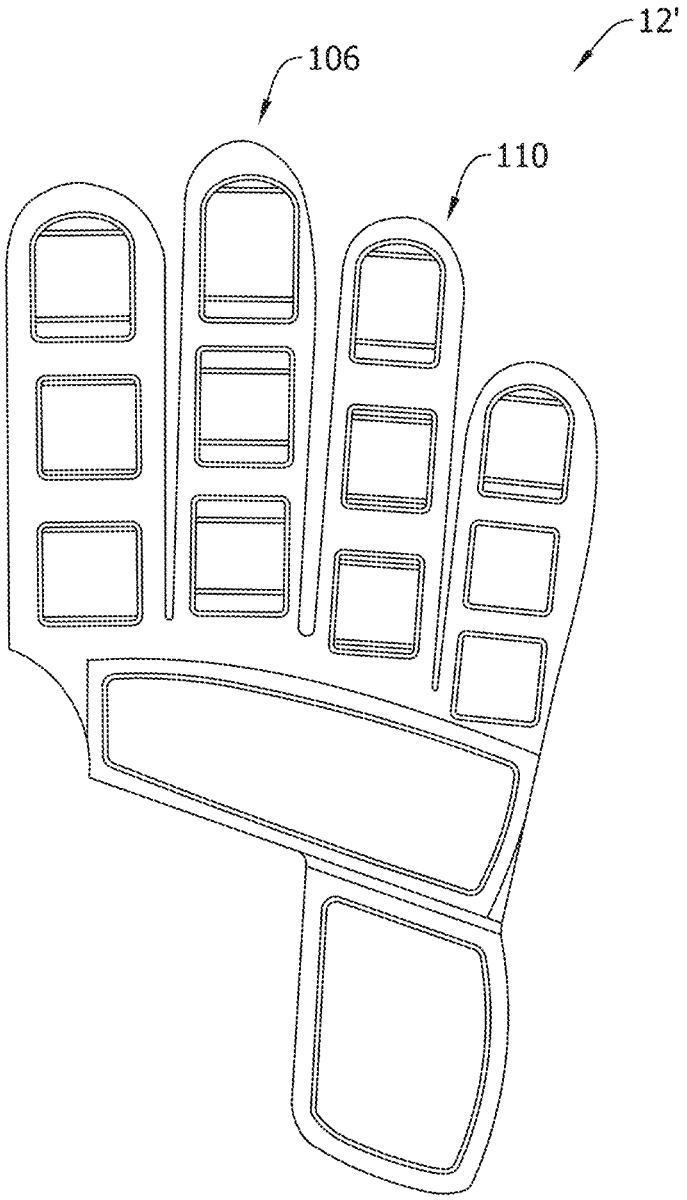
Figure 11:
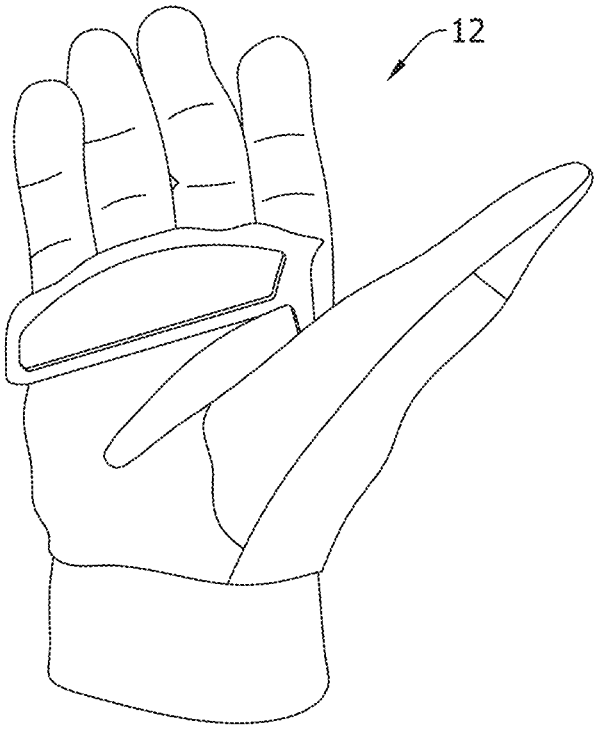
FIGS. 11-17 illustrate perspective views of the dominant sport glove and the second sport glove, according to embodiments of the present invention.
Figure 12:
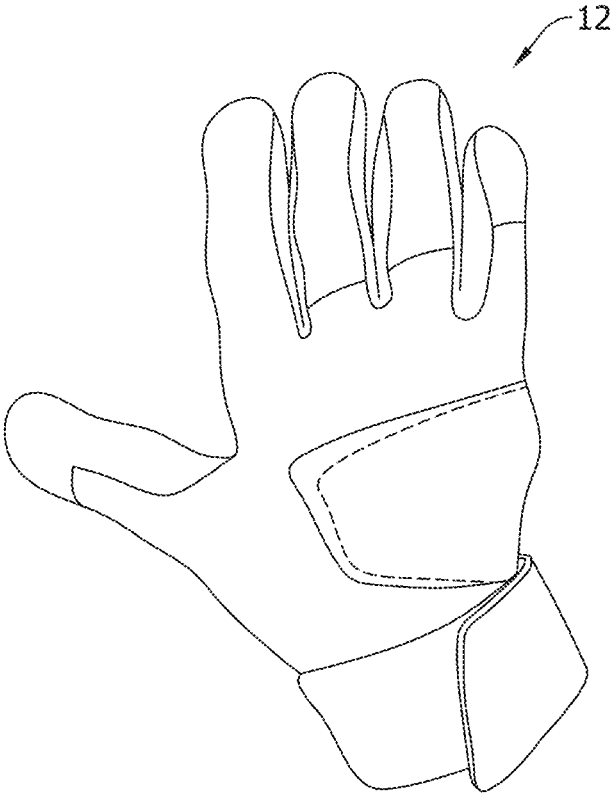
Figure 13:
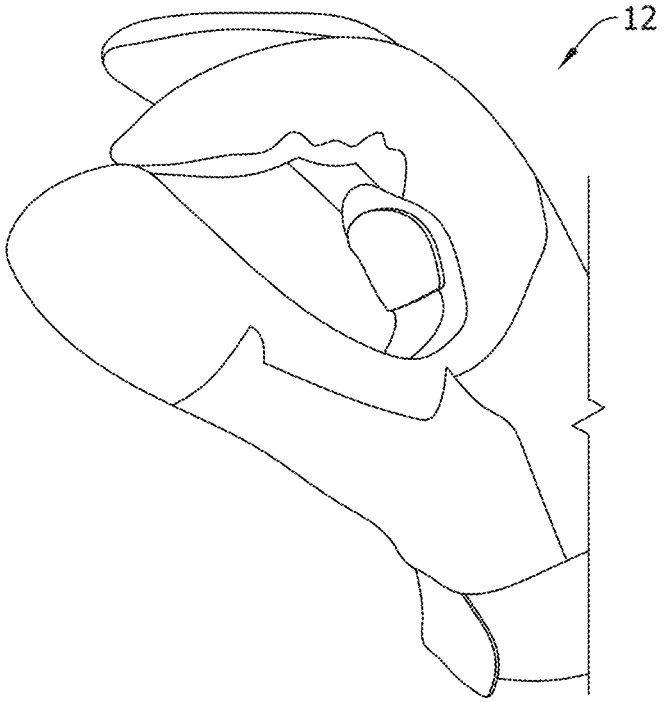
Figure 14:
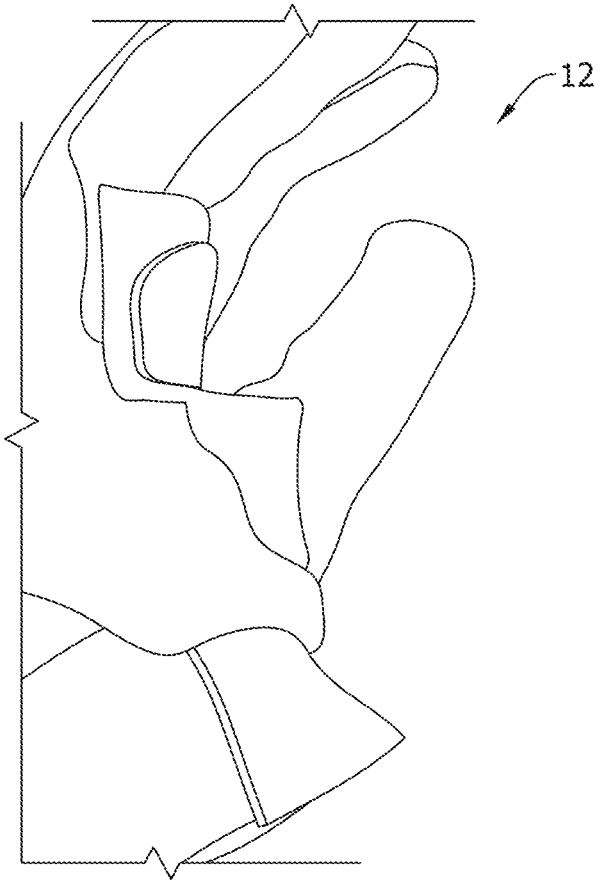

In a fourth embodiment, as shown in FIGS. 9 and 10, the dominant padding assembly 96 and the secondary padding assembly 106 may be sewn right into the body 12, 12' not using a pocket. For example, the plurality of pads 98, 110 are coupled to the body 12, 12' via any means, such as, for example, friction, adhesive, Velcro™, etc. In this embodiment, the padding assembly 96, 106 may be on the inside of the body 12, 12' or on the outside of the body 12, 12'.

In another embodiment, the plurality of pads 98, 110 are one pad including the plurality of finger pads 102, 112, the at least one palm pad 58, 84, and the plurality of thumb pads 104, 114. The one pad includes all of the plurality of pads coupled to each other. The one pad may be coupled to the body 12 via any of the above described embodiments.

In one embodiment, as shown in FIGS. 1A and 1*i*, the plurality of pads 98, 110 are coupled to the body 12, 12' in different positions. The plurality of finger pads 102, 112 are coupled to the front surface 22, 22' of the body 12, 12'. The at least one palm pad 58, 84 is coupled to the front surface 22, 22' of the palm portion 28, 28'. The plurality of thumb pads 104, 114 are coupled to the front surface 22, 22' of the body 12, 12'. The plurality of pads 98, 110 may be coupled to the body 12, 12' using any number of techniques, including, but not limited to, sewing or use of an adhesive. The placement of the padding assembly 96, 106 throughout the sport glove 10, 10' helps protect the hands of the batter and position the bat properly. Each pad is placed to prevent blisters to the batter's hand.

In one embodiment, the plurality of pads 98, 110 have various shapes and sizes. Each pad of the plurality of pads may be a different shape and size, such as, for example, a rectangle, square, circle, or an irregular shape, etc. The size of the pad may vary. For example, as shown in FIG. 4, the palm pad 58 has a top 62 and a bottom 64, where the bottom 64 is opposite the top 62 along a y-axis, a left side 66 and a right side 68, where the right side 68 is opposite the left side 66 along an x-axis, and a front side and a back side where the back is opposite the front along a z-axis. Each pad has a specific thickness of from 0.010 millimeters to 5.00 millimeters.

In one embodiment, the plurality of pads 98, 110 may have the same shape and size.

In yet another embodiment, the top side of each pad is configured to receive the bat by curving around the bat or shaft of the bat. The bottom side of each pad is coupled to the body 12 and the top side has a concave shape, for example, a recessed crescent shaped channel extending the width of the respective pad. In one embodiment, the sides are higher than the center thus providing the concave shape. The concave shape is designed to complement the bat so that the bat comes into contact with and sits within each pad. The crescent shaped channel should have a sufficient depth for gripping the bat. The depth should be sufficient so that the plurality of pads cradle the bat in the proper position.

In one embodiment, the top side of each pad is coupled to the body 12 from the inside of the body 12. In this embodiment, the bottom side of each pad is then in contact with the batter's hands.

In one embodiment, at least one of the plurality of pads have a concave shape. For example, the at least one palm pad 58 is curved and the plurality of finger pads 102 and the plurality of thumb pads 104 are not curved. In another example, the plurality of finger pads 102 are curved and the plurality of thumb pads 104 and the palm pad 58 are not curved. In another example, the plurality of thumb pads 104 are curved and the plurality of finger pads 102 and the at least one palm pad 58 are not curved.

In one embodiment, one or more of the finger pads of the plurality of finger pads 102, but not all, are curved. For example, the finger pads on the top or tip of the finger portions 20 are curved. The thumb pads 104 on the top or tip of the thumb portion 18 may also be curved.

The at least one palm pad 58 is larger than the plurality of finger pads 102 because the palm pad 58 engages the bat during a rolling motion of the palm of the batter's hand. The palm pad 58 provides protection to the batter's hand when in contact with the bat. In one embodiment, as shown in FIG. 2, the webspace pad 14 is generally triangular in shape and is positioned on the inside surface of the palm portion 28. The webspace pad 14 may also be coupled to the thumb portion 18 and the plurality of finger portions 20 providing a web like pad in properly positioning the bat and protecting the batter's hand. In one embodiment, the webspace pad 14 may be positioned between the finger and the thumb to properly position the sport glove 10. The webspace pad 14, as shown in FIG. 6, is shaped like a crescent moon. The webspace pad 14 protects the hand from blisters but also assists in properly positioning the sport glove 10 on the bat. The webspace pad 14 may be any shape such as a rectangle, square, circle, etc.

The plurality of pads may have a thickness between 0.010 millimeters and 5.00 millimeters. The plurality of finger pads 102 may have a thickness, along the z-axis, between 0.010 millimeters and about 5.00 millimeters. The plurality of thumb pads 104 may have a thickness, along the z-axis, between 0.010 millimeters and about 5.00 millimeters. The thickness may vary depending on the shape of the crescent of the corresponding pad.

In the illustrated embodiment, the plurality of finger pads 102 and the plurality of thumb pads 104 are coupled to the plurality of finger portions 20 and the thumb portion 18 along the y-axis, as shown in FIG. 1A. For example, the plurality of finger pads 102 are disposed between the first and second joints of the finger which allows the bat to rest against the plurality of finger pads 102 in the proper position and for protection. The spacing between the plurality of finger pads 102 allows the batter to bend their fingers so that the grip can position the bat properly and the batter is comfortable. The plurality of thumb pads 104 are similar to that of the plurality of finger pads 102.

In one embodiment, the palm pad 58 extends from the left side 48 to the right side 50 of the body 12 across the palm portion 28. As described above, the palm pad 58 has the concave or contoured design, the palm pad 58 is able to receive the bat in the proper position and protect the palm of the batter's hand. Depending on the proper positioning of the padding assembly 96, the at least one palm pad 58 may extend diagonally across the body 12.

In yet another embodiment, the padding assembly 96 includes a plurality of palm pads. The plurality of palm pads may be spread across the palm portion 28 of the body 12 allowing the sport glove 10 to better receive the bat for proper positioning and protection. The plurality of palm pads may extend diagonally across the body 12 from the left side 48 to the right side 50. A second palm pad may extend diagonally across and parallel to the at least one palm pad 58 creating a recess in between the palm pads.

In one embodiment, the dominant padding assembly 96 is manufactured at an angle to properly position the bat in the batter's hand. The angle of the padding assembly 96 varies depending on the sport being played and the hand of the batter, whether right or left. For example, the angle of the padding assembly 96 may be between 5° to 180° along the x-axis. The positioning of the padding assembly 96 promotes and maintains the proper positioning of the bat, for example, over the knuckles of the batter. The plurality of finger pads 102 are angled to be perpendicular with the bottom finger pad along the y-axis. The plurality of thumb pads 104 are angled to be perpendicular with the bottom thumb pad along the y-axis. The at least one palm pad 58 is angled along the x-axis to properly position the bat or shaft of the bat. The angle of the at least one palm pad 58 may be between 5° to 180° along the x-axis. The angle may vary depending on the shape of the crescent of the corresponding pad and the desired positioning of the sport glove 10.

In one embodiment, the padding assembly 96 is made out of a material, for example, but not limited to silicon, foam, foam plastic, neoprene, rubber, silicon rubber, polyurethane, a gel, conventional foam rubbers, cotton batting, and other elastomers used in sports gloves. The material used is configured to cushion and provide shock absorption to protect the hands of the batter.

In one embodiment, the plurality of recesses 100 allow the sport glove 10 to position itself around the bat or the shaft of the bat. The plurality of recesses 100 assist the sport glove 10 in curving around the bat. The plurality of recesses 100 have a predetermined distance between the surrounding pads. The plurality of recesses 100 between the plurality of finger pads 102 have a predetermined distance that is different than the predetermined distance between the plurality of thumbs pads 104. In addition, the at least one palm pad 58 has a predetermined distance between the palm pad 58 and the last finger pad of each finger, similar to the distance between the last thumb pad and the palm pad 58. The predetermined distances of the plurality of recesses 100 are strategically placed to properly position the sport glove 10 around the bat or shaft of the bat.

In one embodiment, the sport glove 10 does not include a plurality of recesses.

Figure 15:
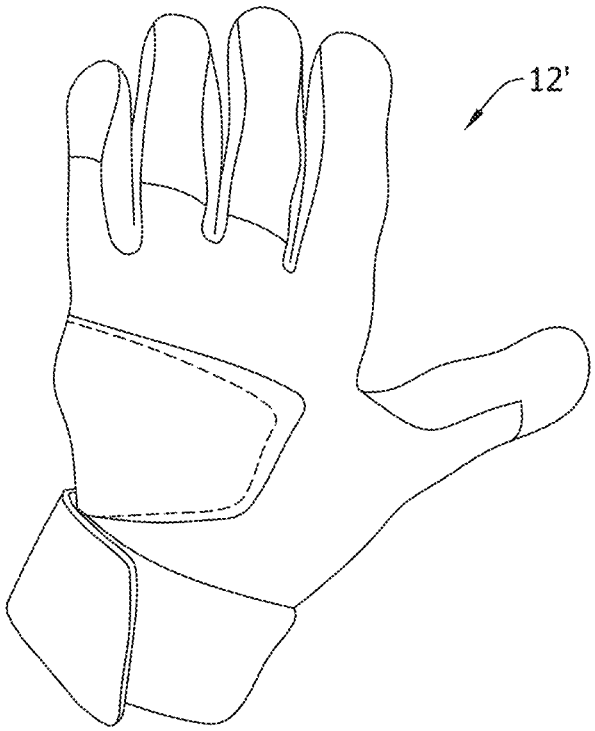
Figure 16:
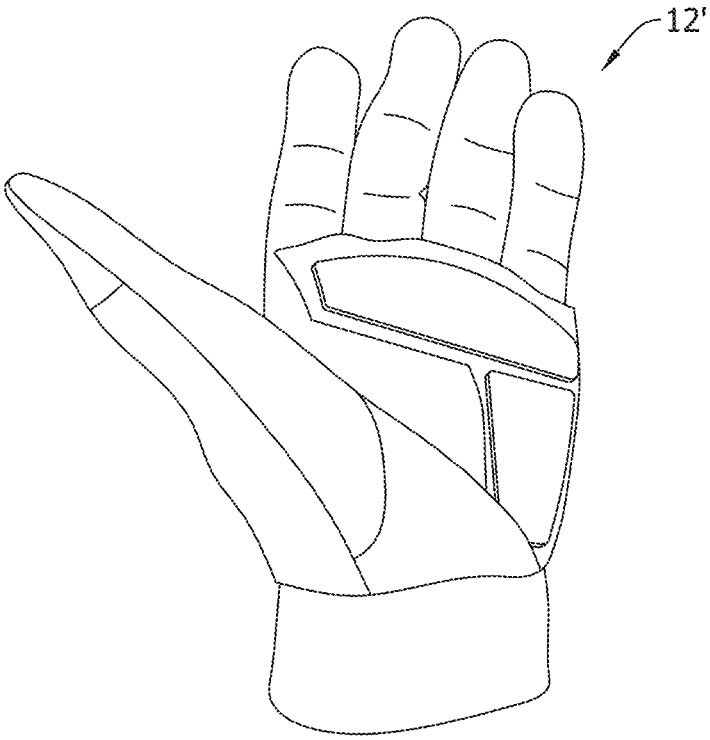
Figure 17:
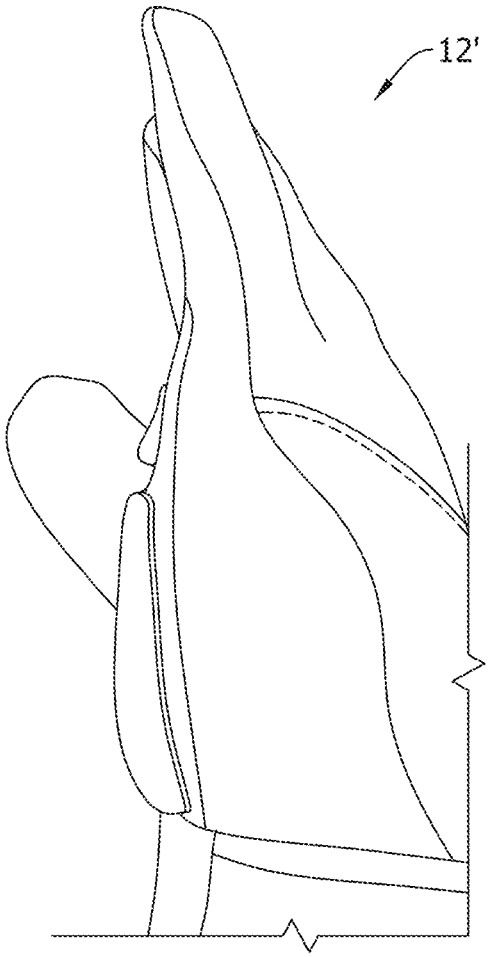

In various embodiments, as shown in FIGS. 11-14, the sport glove 10 for properly positioning a bat and for protecting the dominant hand of a player includes the body 12, the webspace pad 14, and at least one recess 16. In another embodiment, as shown in FIGS. 15-17, the sport glove assembly for properly positioning a bat and for protecting the secondary hand of a player includes a second sport glove 10', the second sport glove 10' includes secondary body 12', the heel pad 42, and at least one recess 16'.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A pair of sport gloves for properly positioning a bat and for protecting a dominant hand and a secondary hand of a player, the pair of sport gloves comprising:

a first sport glove adapted to fit over the dominant hand and including a first padding assembly including:

a first palm pad extending across a palm portion of the first sport glove and adjacent to finger portions of the first sport glove, the first palm pad including a curved top side extending adjacent a bottom of each finger portion; and a webspace pad including a generally triangular shape and spaced from the first palm pad to form a first recess between the webspace pad and the first palm pad configured to receive a handle of the bat, the webspace pad positioned adjacent a thumb portion of the first sport glove and extending inwardly from the thumb portion towards a bottom portion of the first sport glove;

wherein the webspace pad includes:

a first pad side extending along a first glove side of the first sport glove;

a bottom pad side extending from a lower end of the first pad side inwardly towards an opposite second glove side; and a curved upper pad side extending from an upper end of the first pad side to the bottom pad side; and a second sport glove adapted to fit over the secondary hand and including a second padding assembly that is different from the first padding assembly, the second padding assembly including:

a second palm pad extending across a palm portion of the second sport glove adjacent to finger portions of the second sport glove; and a heal pad including a rectangular shape and spaced from the second palm pad to form a second recess between the heal pad and the second palm pad configured to receive the handle of the bat;

wherein the first padding assembly does not include the heel pad and the second padding assembly does not include the webspace pad.

2. The pair of sport gloves of claim 1, wherein the first padding assembly includes a plurality of finger pads.

3. The pair of sport gloves of claim 1, wherein the first padding assembly includes a thumb pad.

4. The pair of sport gloves of claim 1, wherein the webspace pad and the first palm pad are silicon.

5. The pair of sport gloves of claim 1, wherein the second padding assembly includes a plurality of finger pads.

6. The pair of sport gloves of claim 1, wherein the second padding assembly includes a thumb pad.

7. The pair of sport gloves according to claim 1, wherein the second palm pad includes a curved top side.

8. The pair of sport gloves of claim 1, wherein the heal pad and the second palm pad are silicon.

* * * * *